US005893452A

United States Patent [19]

de Nervo

[11] Patent Number: 5,893,452

[45] Date of Patent: Apr. 13, 1999

[54] MONOPIECE BODY FOR THE SEPARATE PACKAGING AND MIXING OF AT LEAST TWO PRODUCTS

[75] Inventor: Stanislas de Nervo, Paris, France

[73] Assignee: L'Oreal, Paris, France

[21] Appl. No.: 08/800,101

[22] Filed: Feb. 13, 1997

[30] Foreign Application Priority Data

Feb. 15, 1996 [FR] France ..... 96 01884

[51] Int. Cl.[6] ..... B65D 25/08

[52] U.S. Cl. ..... 206/219; 215/DIG. 8

[58] Field of Search ..... 206/219, 220, 206/221, 222; 215/DIG. 8

[56] References Cited

U.S. PATENT DOCUMENTS

| | | | |
|---|---|---|---|
| 2,533,806 | 12/1950 | Holzapfel | 206/221 |
| 2,545,302 | 3/1951 | Perez Lias | 206/221 |
| 2,756,129 | 7/1956 | Harris | 206/221 |
| 2,764,983 | 10/1956 | Barasch et al. . | |
| 2,787,268 | 4/1957 | Greenspan | 206/221 |
| 3,856,138 | 12/1974 | Maekawa et al. | 206/221 |
| 4,410,085 | 10/1983 | Beneziat et al. . | |

FOREIGN PATENT DOCUMENTS

| | | |
|---|---|---|
| 1224465 | 6/1960 | France . |
| 2648696 | 12/1990 | France . |
| 2658484 | 8/1991 | France . |
| 51-128757 | 3/1950 | Japan . |
| 53-28063 | 8/1951 | Japan . |
| 55-127067 | 3/1954 | Japan . |
| 58-151581 | 10/1983 | Japan . |
| 59-168315 | 11/1984 | Japan . |
| 63-76641 | 5/1988 | Japan . |
| 1-122478 | 8/1989 | Japan . |
| 1-144336 | 10/1989 | Japan . |
| 2-132627 | 11/1990 | Japan . |
| 3-673 | 1/1991 | Japan . |
| 4-106221 | 9/1992 | Japan . |
| 5-22339 | 3/1993 | Japan . |
| 5-35653 | 5/1993 | Japan . |
| WO 89/08590 | 9/1989 | WIPO . |
| WO 95/23744 | 9/1995 | WIPO . |

*Primary Examiner*—Jacob K. Ackun

*Attorney, Agent, or Firm*—Oblon, Spivak, McClelland, Maier & Neustadt, P.C.

[57] ABSTRACT

The present invention relates to a container for the separate packaging and mixing of at least one base product and at least one secondary product in a single body. The container is provided with an internal stopper, a device for opening the internal stopper, and a membrane, and can be easily and economically manufactured.

24 Claims, 4 Drawing Sheets

MONOPIECE BODY FOR THE SEPARATE PACKAGING AND MIXING OF AT LEAST TWO PRODUCTS

BACKGROUND OF THE INVENTION

Field of the Invention

The present invention relates to a container for the separate packaging, then mixing, of at least two products. It is often necessary to obtain a mixture of several products at the time of their use, the separate products readily enduring prolonged storage, whereas their mixture rapidly changes. Such a packaging may be used, for example, for the marketing of pharmaceutical, cosmetic or photographic products. The container of the present invention relates to the storage and mixing of products with a poor flow rate, in particular the storage and mixing of several products of which at least one is viscous, as for example, the storage and mixing of a powder with a cream or a paste, or of two creams. By way of example, we may cite dyeing products.

DISCUSSION OF THE BACKGROUND

Several related packages, in particular as shown in FR-A-2283064, FR-A-2602752, FR-A-2396701, EP-A-0417998, permit separate storage of two products and their exposure to contact just before use. However, these packages in essence permit mixing under the action of gravity, which is unsuitable in the case of viscous products or powders, which products have a poor flow rate.

More precisely, in FR-A-2283064 the proposed system permits the separate storage of a solid and of a liquid which are separated by a tearable membrane. In this system the incomplete opening between the two compartments containing each product, which opening is due to the tearing off of the membrane, would be insufficient to permit an easy and homogeneous mixing of the products in the case where one of these products may be a paste, a cream or a powder.

In the system of FR-A-2602752, one of the products is a liquid which comes to impregnate a pad contained in another cavity, the two cavities being separated by a tearable membrane. In the case of a paste, a cream or a powder, this package therefore has the same drawbacks (difficulties of flow and of mixing) as those described above.

The same applies to FR-B-2396701. Moreover, the containers according to this patent are constituted by the assembly and welding of several compartments; now the high number of parts of such a container entails a not insignificant additional cost as compared with a container made of a single piece.

In the system described in EP-A-0417998, the container comprises an upper compartment of a tubular shape, which is unsuitable for mixing when the product stored in the upper compartment is a cream and therefore has a poor flow rate. This shape also has a drawback in that it does not easily permit the mixing of the products by means of an implement such as a stick or a brush. This drawback is common to the other related systems. Moreover, this container is manufactured by injection blow-molding which is an expensive technique. U.S. Pat. No. 4,410,085 and WO-A-95/23744 describe devices which permit the simultaneous mixing of two products contained in two cavities, one being the main and the other being the secondary contained in the main cavity, the two cavities being separated by a stopper. However, in each of these devices it is necessary to open the main cavity before opening the secondary cavity. Consequently, a clumsy manipulation at the time when the secondary cavity is being opened entails the risk that the product contained in the main cavity will spread out of the container.

Thus it is with surprise that the Applicant has discovered an inexpensive container for the separate packaging of at least one base product and at least one secondary product, in a single body which can be manufactured in advantageous economic conditions. This container permits in particular the storage and mixing, in good conditions, of products with a poor flow rate, in particular of several products at least one of which is viscous as, for example, two creams, or a powder with a cream or a paste.

SUMMARY OF THE INVENTION

Therefore, an object of the present invention is to provide a monopiece container, for the separate packaging and mixing of at least one base product and at least one secondary product, comprising a body, an internal stopper, a closing means, and a device for opening the internal stopper. The body comprises a wall which defines the profile of a main bowl-shaped cavity capable of containing the base product, and the profile of a secondary cavity capable of containing the secondary product. The secondary cavity is included in the main cavity, and the internal stopper allows the secondary cavity to be hermetically sealed from the main cavity. The closing means makes it possible to seal the main cavity hermetically from the external air. The means for opening the internal stopper makes it possible to remove the internal stopper before, or simultaneously with, the opening of the main cavity.

This device makes it possible to avoid risky manipulations at the time when the secondary cavity is being opened because this manipulation is then effected either while the main cavity is still closed and the contents of the two cavities cannot therefore expand outwardly, or simultaneously with the opening of the main cavity, and the user does not have to manipulate the stopper of the secondary cavity after the main cavity has already been opened and when its content could escape therefrom.

The profile of the main cavity has the overall shape of a bowl. The profile of the secondary cavity can be inscribed in the shape of a protuberance. The profile of the main cavity may also be provided with a flat bottom.

The bowl shape permits in particular an easy mixing, of the products contained in the body, by means of implements as, for example, a brush or a stick. This facility is extremely advantageous for obtaining a homogeneous mixture from products with a poor flow rate, in particular from products at least one of which is viscous. This mixing facility is all the more important when the user of the products is not an expert but is an ordinary consumer.

The body is made of a thermoplastic material. It may be the result of a superposition of several different thermoplastic materials and it may be manufactured by any means known to the expert, as for example thermoforming, injection molding, or blow molding. In order to render the product economically advantageous, it is preferentially manufactured by thermoforming or by injection molding, and in a preferred embodiment, it is manufactured by thermoforming.

As the thermoplastic material, one may for example use polyethylene, polypropylene, or a copolymer of ethylene and propylene.

The closing means may be an external stopper positioned at the opening of the main cavity; in this case, the body has complementary fastening means at the circumference of the main cavity. The closing means may also be a membrane which can be torn off in one piece.

In the case where the closing means is a membrane that can be torn off in one piece, the membrane is made of a material which is airtight and is chemically compatible with the main and secondary products. The membrane is fixed to the wall of the body and placed at the opening of the main cavity. The fixing of the membrane to the body must be leakproof and at the same time manually strippable. Moreover, it is necessary for the membrane to be of a material such that it does not tear when it is torn off from the body, but that, on the contrary, it can be removed in a single piece. Such a membrane is usually constituted by at least three superposed layers; the central layer, which may be of aluminum or of a thermoplastic material, determines the seal of the membrane, the upper layer which may be made of a thermoplastic material ensures that the membrane is not liable to tearing, and the lower layer is a thermoplastic film which renders the membrane peelable.

The internal stopper is in essence constituted by a skirt and a bottom; it has to permit the leakproof sealing of the secondary cavity; it also has to be easily removable before or simultaneously with the opening of the main cavity, so as to allow the mixing of the two products before use. The secondary cavity is provided at its ends with fastening means which cooperate with the skirt of the stopper and allow it to be fixed in a leakproof manner.

The internal stopper is preferably made of a thermoplastic material; it may be manufactured by any means known to the expert, as for example by the thermoforming of an extruded film or by injection molding. Preferentially, the stopper will be manufactured by injection molding; this more precise technique makes it possible to facilitate obtaining a better seal.

To allow the user to remove the stopper, several solutions may be envisaged.

In a first variant, the profile of the secondary cavity has a rigid finger and a zone deformable at the circumference and at a first end of this finger. The finger and the deformable zone cooperate in such a way that pressure exerted on the deformable zone causes the internal stopper to be ejected by pressing on the internal stopper from its other end. Preferably, this action has to be effected before the membrane has been removed. The circumference of this finger may be rendered deformable by any means known to the expert, as for example by the presence of grooves in the profile of the cavity, or by a lesser thickness of the thermoplastic material at the circumference of this finger. Optionally, the internal stopper may be provided with an internal skirt wherein the rigid finger comes to be positioned and which prevents it from being bent under pressure.

In a second variant, the internal stopper comprises a rigid stem whose end rests on the wall of the secondary cavity. Pressure exerted on this wall allows the stopper to be ejected. This action must also be effected before the membrane has been removed.

In a third variant, the internal stopper is provided with a fixed tongue comprising two ends, one end being fixed to the internal stopper, and the other end being fastened to the closing means by means of a nonstrippable fixing, in particular when the closing means is a strippable membrane. The fixing of the tongue to the membrane is different from the fixing of the membrane to the body. Thus when the user removes the membrane, the membrane draws along with it the tongue and the internal stopper. This solution has the advantage that it permits the opening of the two cavities in one action and allows the internal stopper to be drawn along out of the container.

In a fourth variant, the internal stopper has a hollow skirt of a sufficient height for the bottom to emerge from the main cavity at the level of the upper wall of the body, and the bottom of the internal stopper is sealed to the closing means.

According to the invention, the seal of the bottom of the internal stopper to the closing means is not strippable; in particular, when the closing means is a strippable membrane, the sealing of the internal stopper to the membrane is different from the sealing of the membrane to the body; thus when the user removes the membrane, the membrane draws along with it the internal stopper to be drawn out of the container thereby.

According to the first three variants of the invention, the manufacturer first fills the secondary cavity with the secondary product; then he obturates this cavity by using the internal stopper; subsequently he fills the main cavity and obturates it, optionally by fastening the tongue to the membrane in the case of the fourth variant.

According to the fourth variant the manufacturer may, depending on the shape of the cavity, proceed in the same way as in accordance with the preceding variants. He may also place the secondary product inside the hollow internal stopper, with the stopper upended so as to rest on its bottom; he subsequently fixes the body to the stopper, then he inverts the assembly and fills the main cavity; the he fixes the closing means by sealing the bottom of the internal stopper to the membrane.

Depending on the case, the profile of the body may be provided with a flat bottom which allows it to rest on a flat surface; this body may also comprise a skirt which allows it to rest on a flat surface irrespective of the profile of the rest of the body.

After having removed the membrane and opened the secondary cavity, the user can mix the base product and the secondary product, by means of any known implement such as a brush or a stick.

The container in accordance with the invention may, moreover, comprise a sample cavity arranged in the wall of the body, this cavity being capable of containing a sample dose of the base product or of the secondary product. This cavity is obturated by a closing means of the same type as that which obturates the main cavity. However, these two means are separate, which makes it possible to open the sample cavity and to dose the product contained therein without opening the main cavity.

The container in accordance with the invention may moreover contain a cavity, for implements, arranged in the wall of the body, this cavity being capable of containing various implements useful for manipulating the products, such as, for example, gloves, a brush etc. . . . In the same way as the sample cavity, the cavity for the implements may be closed by an independent closing means; it may, however, be closed by the same closing means as the main cavity.

The present invention accordingly relates to a container for a separate packaging and mixing of at least one base product and at least one secondary product. The container comprises a body, an internal stopper, a closing means and a device for opening the internal stopper. The body comprises a wall that defines a profile of a main bowl-shaped cavity which is capable of containing the base product and a profile of a secondary cavity which is capable of containing the secondary product.

The secondary cavity is included in the main cavity, and the internal stopper allows the secondary cavity to be hermetically sealed from the main cavity. The closing means makes it possible to seal the main cavity hermetically from external air, and the means for opening the internal stopper makes it possible to remove the internal stopper before, or simultaneously with, the opening of the main cavity.

The present invention further relates to a container for separately packaging and mixing at least one base product and at least one secondary product. The container comprises a body containing a first cavity for containing the at least one base product and a second cavity for containing the at least one secondary product; a stopper for sealing the second cavity from the first cavity; a closing means for sealing the first cavity from external air; and opening means for opening the stopper to communicate the second cavity with the first cavity.

BRIEF DESCRIPTION OF THE DRAWINGS

In describing the preferred embodiments of the present invention illustrated in the drawings, specified terminology is employed for the sake of clarity. However, the invention is not intended to be limited to the specific terminology so selected, and it is to be understood that each specific element can include technical equivalents which operate for a similar purpose.

A more complete appreciation of the invention and many attendant advantages thereof will be readily obtained as the same becomes better understood by reference to the following detailed description when considered in connection with the accompanying drawing, wherein.

DESCRIPTION OF THE PREFERRED EMBODIMENTS

Figure 1:
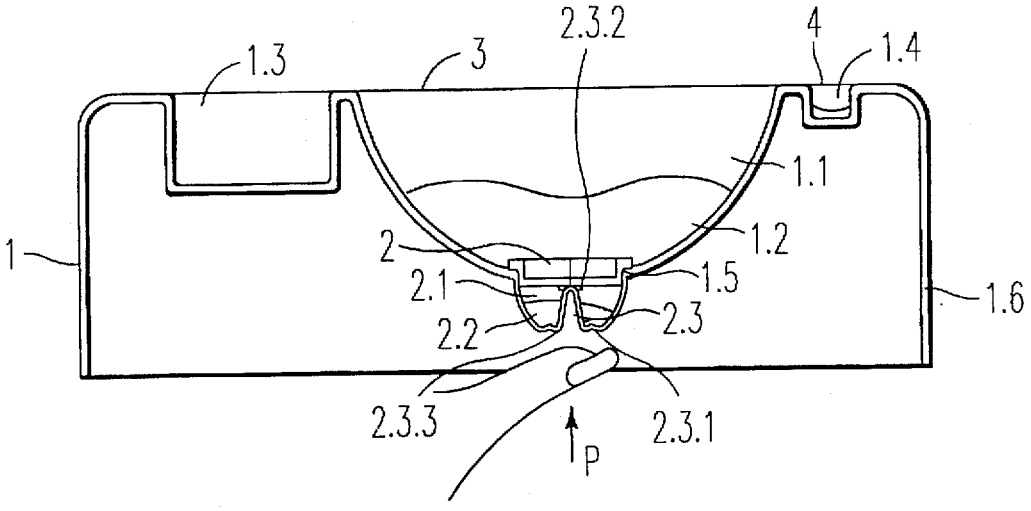
FIG. 1 shows a cross-section of a device in accordance with the invention, whose opening is effected by means of a finger positioned on the wall of the secondary cavity.

Referring now to the drawings, wherein like reference numerals designate identical or corresponding parts throughout the several views, the container shown in FIG. 1 includes a body 1 made of thermoformed polyethylene, an internal stopper 2, and two heat-sealed membranes 3 and 4. The body 1 has the shape of a teat which defines a main bowl-shaped cavity 1.1 and a secondary cavity 2.1 at the bottom of the main cavity 1.1; catch engagement-type fastening means 1.5 permit a leakproof fixing of a stopper 2 which separates the cavity 1.1 containing a product 1.2 and the cavity 2.1 containing a product 2.2. The products 1.2 and 2.2 can be respectively a cream and a powder for the coloring of hair. A peripheral circular skirt 1.6 allows the container to be placed on a flat surface. For this purpose, the skirt 1.6 has a height at least equal to that of the teat. Moreover, the wall of the body 1 has at the level of the cavity 2.1, a finger 2.3 and an annular groove 2.3.1 around the finger 2.3. The upper end of the finger 2.3 is placed into a skirt 2.3.2 of the stopper 2 extending in the secondary cavity 2.1. The annular groove 2.3.1 renders the zone 2.3.3 deformable at the circumference of the finger 2.3. A pressure P can be exerted on the zone 2.3.3 at the base of the finger 2.3 to cause the stopper 2 to be ejected. Subsidiary cavities 1.3 and 1.4 respectively permit the storage of various utensils and of a sample of the product 2.2. The cavity 1.4 is obturated by the membrane 4 which is independent of the membrane 3. The membrane 3 obturates the main cavity 1.1 and the subsidiary cavity 1.3 at the same time.

In a first stage, the user tears off the membrane 4 and uses the sample contained in 1.4 to test the tolerance of this product on his skin. Then he upends the container and exerts pressure on the deformable zone 2.3.3 at the base of the finger 2.3, thus removing the stopper 2. He again turns the container over and tears off the membrane 3; the utensils contained in 1.3 are then accessible and he can use them to mix the products 1.2 and 2.2.

Figure 2A:
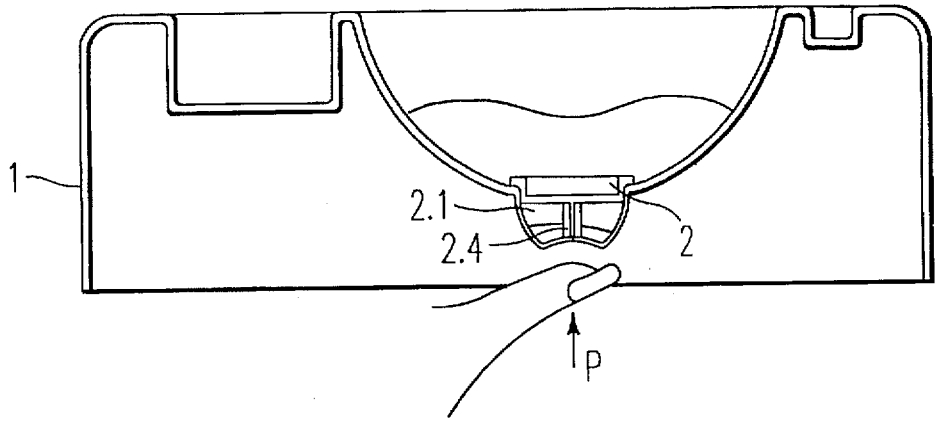
FIGS. 2*a* and 2*b* show a cross-section of a device in accordance with the invention, whose opening is effected by means of a rigid stem fixed to the stopper.
Figure 2B:
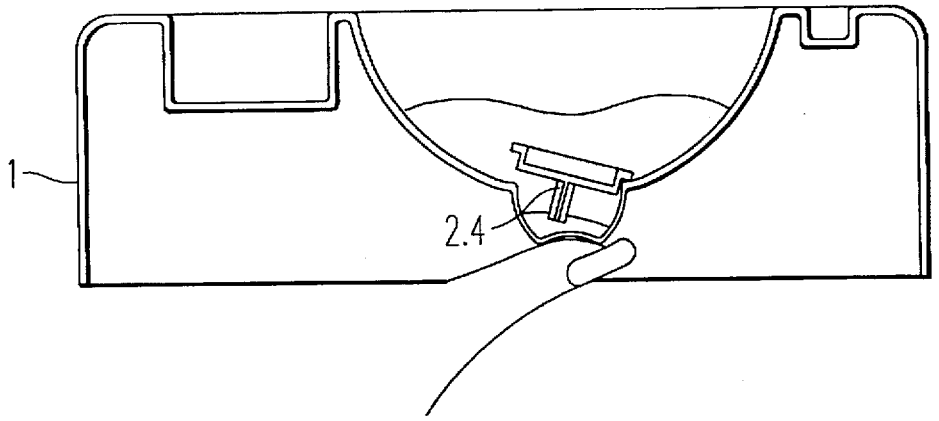

The container shown in FIGS. 2*a* and 2*b* differs from that of FIG. 1 by the absence of the finger in the secondary cavity and by the existence of a rigid stem 2.4 fixed to the internal stopper 2 and having its end opposite the wall of the cavity 2.1. The mode of use illustrated in FIG. 2*b* is the same as in FIG. 1. The deformable zone has a thickness less than that of the wall of the body 1 situated opposite the end of the stem 2.4.

Figure 3:
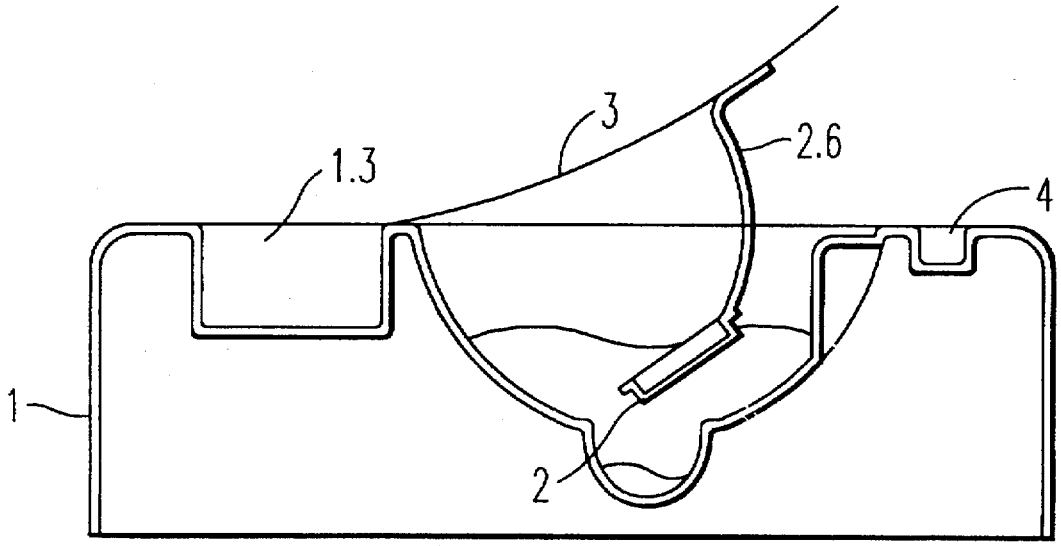
FIG. 3 shows a cross-section of a device in accordance with the invention, whose opening is effected by means of a fixed tongue.

The container shown in FIG. 3 differs from that of FIG. 1 by the absence of a finger in the secondary cavity, and by the existence of a fixed tongue 2.6. The tongue 2.6 has two ends, one of these ends is fixed to the internal stopper 2, and the other is fastened to the membrane 3. After the opening of the membrane 4, permitting access to the sample, the user tears off the membrane 3; he also draws along the tongue 2.6, as well as the internal stopper 2; he can then mix the products by means of the utensils extracted from the cavity 1.3.

Figure 4A:
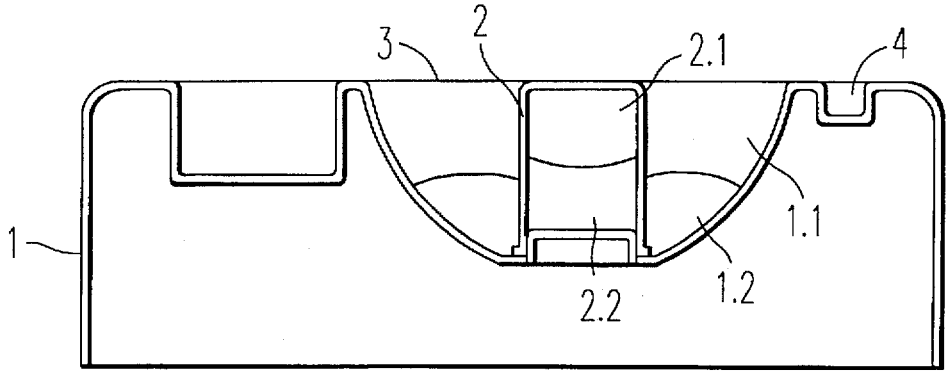
FIGS. 4*a*, 4*b* and 4*c* show both (i) a cross-section of a device in accordance with the invention, the device comprising an emergent stopper sealed to the closing means of the main cavity, as well as (ii) a method for filling the device.
Figure 4B:
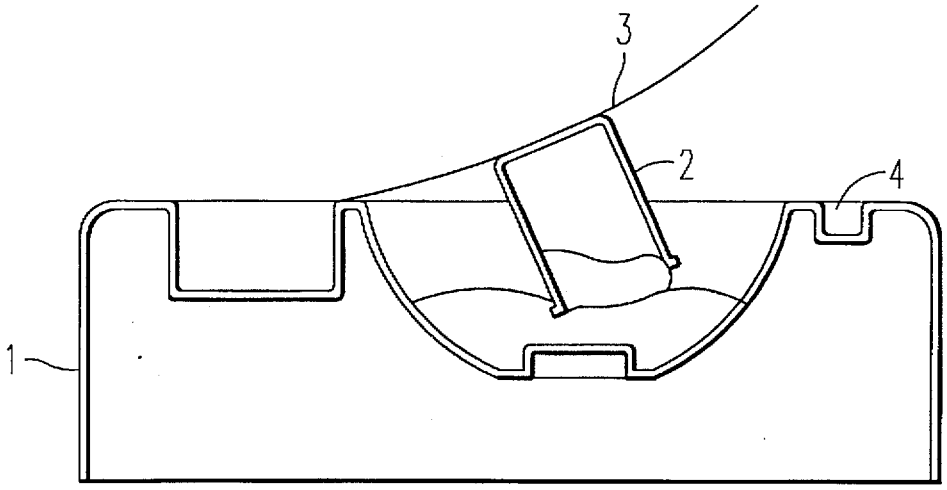
Figure 4C:
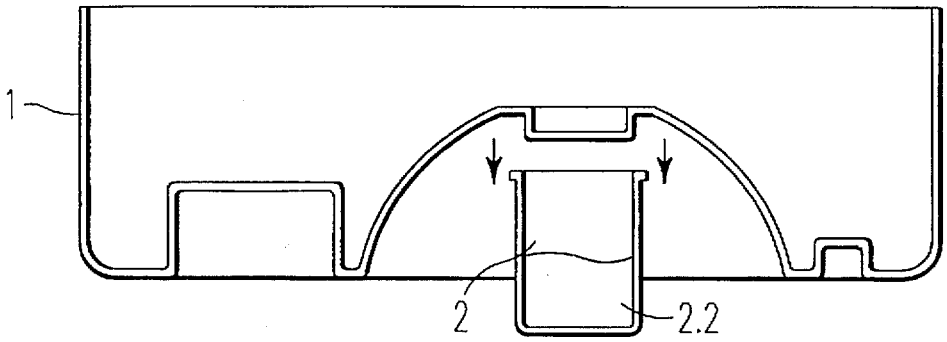

The device shown in FIGS. 4*a*, 4*b* and 4*c* is constituted by a body 1 and an internal stopper 2 and by two membranes 3 and 4. This device is distinguished from that of FIG. 1 in that the internal stopper 2 has a cylindrical skirt of a height such that the bottom of the stopper 2 is flush with the surface of the main cavity 1.1 which is bowl-shaped. The bottom of the stopper 2 is sealed to the membrane 3 obturating the main cavity 1.1 in such a way that, when the membrane 3 is torn off, the stopper 2 which is integral therewith opens and releases the secondary product 2.2 which it was holding in the cavity 2.1. As shown in FIG. 4*c*, at the time of packaging, the stopper 2 is filled with the product 2.2; then the body 1 is positioned on the stopper 2 in a leakproof manner, and only subsequently is the body 1 upended and the main cavity 1.1 is filled with the product 1.2.

Figure 5:
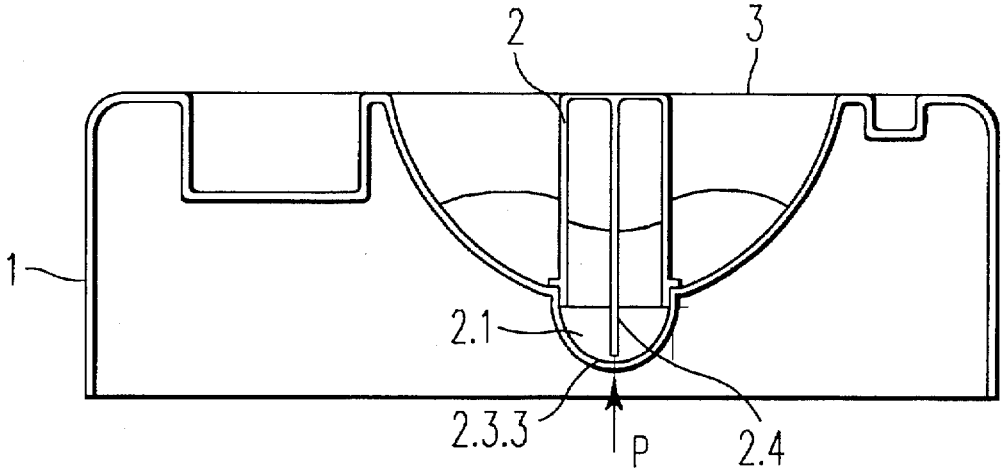
FIGS. 5 and 6 each show a cross-section of a device in accordance with the invention, these devices each containing an emergent stopper, provided with a rigid stem, fastened to the closing means of the main cavity.

The device shown in FIG. 5 is distinguished from that of FIGS. 4*a* and 4*b* by the presence of a rigid stem 2.4 which is fixed to the internal stopper 2 and has its end opposite the wall of the cavity 2.1. In a first stage, the user takes out the stopper 2 by exerting pressure on the deformable zone 2.3.3; then he removes the membrane 3 which draws the stopper 2 with it out of the container. As compared with the preceding one, this device has the advantage that it avoids splashing when the stopper 2 is opened.

Figure 6:
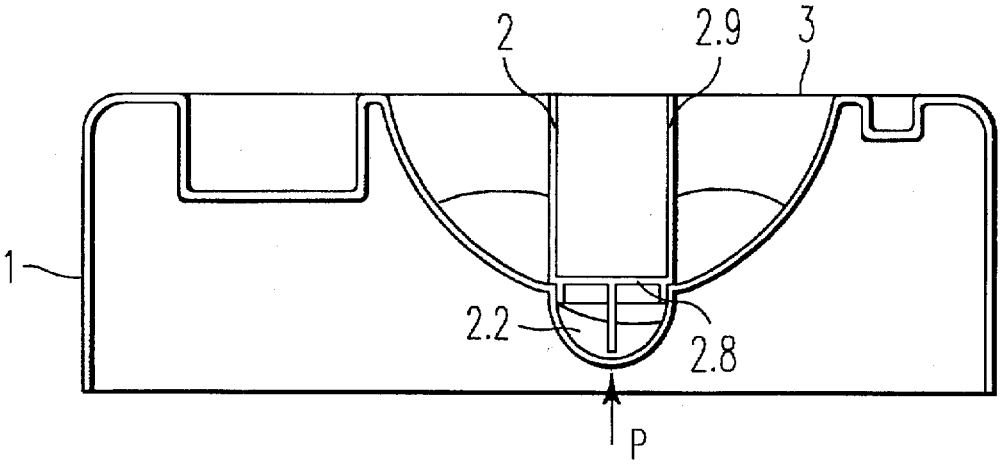

The device shown in FIG. 6 is distinguished from that of FIG. 5 in that the bottom 2.8 of the stopper 2 is placed at a lower level. The stopper 2 adheres by its skirt 2.9 to the membrane 3. The functioning is the same as that described for FIG. 5. This device has the advantage, as compared with the preceding one, that it prevents a portion of the product 2.2 from remaining stuck to the walls of the stopper 2.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A container, for a separate packaging and mixing of at least one base product and at least one secondary product, the container comprising:

a body, an internal stopper, a closing means, and means for opening the internal stopper;

wherein the body comprises a wall that defines a profile of a main bowl-shaped cavity having a generally semi-circular which is capable of containing the base product said wall further defining a profile of a secondary cavity which is capable of containing the secondary product, the secondary cavity being included in the main cavity wherein the internal stopper allows the secondary cavity to be hermetically sealed from the main cavity;

wherein the closing means makes it possible to seal the main cavity hermetically from external air; and wherein the means for opening the internal stopper makes it possible to remove the internal stopper before, or simultaneously with, the opening of the main cavity.

2. A container according to claim 1, wherein the body is made of a thermoplastic material.

3. A container according to either of claim 1, wherein the body is made of polyethylene, polypropylene, or a copolymer of ethylene and of propylene.

4. A container according to claim 1, wherein the body is made of a thermoformed or injection-molded material.

5. A container according to claim 1, wherein the body is made of several different superposed thermoplastic materials.

6. A container according to claim 1, wherein:

the closing means is an external stopper; and the main cavity is provided at its ends with fastening means which allow the external stopper to be fixed in position.

7. A container according claim 1, wherein the closing means is a membrane that can be torn off in one piece.

8. A container according to claim 7, wherein the membrane is fixed to the body by heat sealing.

9. A container, for a separate packaging and mixing of at least one base product and at least one secondary product, the container comprising:

a body, an internal stopper, a closing means, and means for opening the internal stopper;

wherein the body comprises a wall that defines a profile of a main bowl-shaped cavity which is capable of containing the base product and a profile of a secondary cavity which is capable of containing the secondary product, the secondary cavity being included in the main cavity; the internal stopper allows the secondary cavity to be hermetically sealed from the main cavity;

wherein the closing means makes it possible to seal the main cavity hermetically from external air, wherein the means for opening the internal stopper makes it possible to remove the internal stopper before, or simultaneously with, the opening of the main cavity; and wherein the wall of the secondary cavity comprises a rigid finger and a deformable zone which is deformable both at a circumference of the rigid finger and at a first end of the rigid finger, the rigid finger and the deformable zone cooperating in such a way that pressure exerted on the deformable zone causes the internal stopper to be ejected by pressing on said internal stopper from a second end of the rigid finger.

10. A container according to claim 9, wherein the deformable zone has at least one groove at the circumference of the rigid finger.

11. A container according to claim 10, wherein the deformable zone has a zone of thermoplastic material of lesser thickness then at the circumference of the rigid finger.

12. A container according to claim 9, wherein the internal stopper is provided with an internal skirt, and the rigid finger can be positioned in the internal skirt which prevents the skirt from being bent.

13. A container according to claim 1, wherein the internal stopper has a rigid stem having an end which rests on the wall of the secondary cavity.

14. A container according to claim 1, wherein the internal stopper is provided with a sealed tongue having first and second ends, one of the first and second ends being fixed to the internal stopper and the other of the first and second ends being fastened to the closing means by means of a nonstrippable seal.

15. A container according to claim 1, wherein the internal stopper has a skirt of a sufficient height for a bottom of the internal stopper to emerge from the main cavity above a level of the main product, and the bottom of the stopper is fastened to the closing means by means of a nonstrippable seal.

16. A container according to claim 1, wherein the wall of the body is provided with a flat bottom.

17. A container according to claim 1, wherein the body is provided with a skirt which allows the body to be held in position on a flat support.

18. A container according to claim 1, wherein the body comprises a further cavity which is capable of containing a sample dose of the base product or of the secondary product.

19. A container according to claim 1, wherein the body comprises a further cavity which is capable of containing at least one implement useful for a manipulation of the products.

20. A container according of claim 1, wherein said container contains at least a base product which is a viscous product.

21. A container according to claim 1, wherein said container contains at least a base product which is a cream or a paste.

22. A container according claim 1, wherein said container contains a secondary product which is a cream, a paste or a powder.

23. A container according claim 1, wherein said container contains a base and a secondary product which are coloring products.

24. A container for separately packaging and mixing at least one base product and at least one secondary product, the container comprising:

a body including a first cavity for containing the at least one base product and a second cavity for containing the at least one secondary product;

a stopper for sealing the second cavity from the first cavity, said stopper configured to form a seal substantially along a periphery of an intersection between said first and said second cavity, wherein said periphery is substantially a same size as a maximum diameter of said second cavity;

a closing means for sealing the first cavity from external air; and opening means for opening the stopper to communicate the second cavity with the first cavity without traversing a wall of the first cavity.

* * * * *

UNITED STATES PATENT AND TRADEMARK OFFICE

CERTIFICATE OF CORRECTION

PATENT NO. : 5,893,452
DATED : April 13, 1999
INVENTOR(S) : Stanislas de Nervo

It is certified that error appears in the above-identified patent and that said Letters Patent is hereby corrected as shown below:

Column 4,
Line 14, after "stopper", insert -- . This solution has the advantage that it allows the two cavities to be opened in a single action and the internal stopper --; and
Line 28, change "the" to -- then --.

Signed and Sealed this

Eighth Day of March, 2005

JON W. DUDAS
*Director of the United States Patent and Trademark Office*